United States Patent [19]

Wandrisco

[11] 4,061,270

[45] Dec. 6, 1977

[54] STEEL TIE INSULATING SADDLE

[75] Inventor: Joseph M. Wandrisco, Salem Township, Westmoreland County, Pa.

[73] Assignee: United States Steel Corporation, Pittsburgh, Pa.

[21] Appl. No.: 675,437

[22] Filed: Apr. 9, 1976

[51] Int. Cl.[2] ..... E01B 9/54

[52] U.S. Cl. ..... 238/107; 238/59; 238/154; 238/187; 238/280; 238/350

[58] Field of Search ..... 238/59, 107, 154, 280, 238/283, 287, 310, 315, 321, 327 R, 350, 54, 60, 61, 187, 205, 216, 217, 264, 272

[56] References Cited

U.S. PATENT DOCUMENTS

| | | | |
|---|---|---|---|
| 344,011 | 6/1886 | Sayre | 238/350 X |
| 1,104,660 | 7/1914 | Gorrell | 238/107 X |
| 1,676,888 | 7/1928 | Cheney | 238/321 X |
| 1,758,093 | 5/1930 | Thorn | 238/107 X |
| 2,094,279 | 9/1937 | Moses | 238/283 |
| 2,405,533 | 8/1946 | Varney | 238/350 X |

FOREIGN PATENT DOCUMENTS

| | | | |
|---|---|---|---|
| 954,257 | 12/1956 | Germany | 238/283 |

*Primary Examiner*—L. J. Paperner
*Assistant Examiner*—Randolph A. Reese
*Attorney, Agent, or Firm*—William A. Danchuk

[57] ABSTRACT

A unitized insulating element for use with a steel cross tie is provided. The insulating element is operative to electrically insulate the rail from the steel tie, from retaining elements associated with the tie which prevent lateral movement of the rail relative to the tie and from rail anchors which prevent longitudinal movement of the rail relative to the tie. The insulating element permits use of the rail as an on-line signal control conveying device when steel ties are used and is configured as a tie plate substitute from providing an inwardly-directed cant for the rail to be retained thereon.

10 Claims, 4 Drawing Figures

STEEL TIE INSULATING SADDLE

BACKGROUND OF THE INVENTION

Steel cross ties have been used for over a century in railways throughout the world. Like timber cross ties there has been little need to make any major modifications to their design, such that existing designs for steel cross ties and their related elements no longer meet present-day track requirements.

Until 1920, when creosoted wood ties became available, steel ties were used extensively, and both the beam and channel types were produced. As the life of the untreated wood tie was increased from approximately 8 years to approximately 30 years, by the creosoting treatment, steel ties became noncompetitive. However, small quantities of steel ties have been produced recently for light duty service in mines and foreign narrow gage railroads.

The relatively low recent usage of steel cross ties throughout the world has been attributed to both technical and economic considerations. The difficulties of maintenance, particularly packing and alignment, were real before the introduction of mechanical tampers, but at present it is felt that these difficulties are unreal and the strong evidence of overseas employment of the same must be taken into account. Prompted by the continually increasing prices and reduced availability of good hardwood railroad cross ties, several railroads within the United States have made serious studies regarding the possible availability of a suitable steel tie that is priced competitively.

In view of the high price of wood ties, the reduced availability of better grades of hardwood, and the reluctance of the railroads to use concrete ties, there has been a definite promotion of development of a steel cross tie. Moreover, the increased labor costs for maintaining wooden ties, in addition to increased tie plate wearing due to newer and larger freight cars, has necessitated a reevaluation of the steel tie with regard to currently operating as well as future planned railroads.

The first metal cross tie was made from cast iron and was used in Scottish mines at the beginning of the 19th century in the form of flat plates. The trough-type cross tie appeared in England about 1860 and spread to France, Germany and Switzerland about 1870. They did not spread any further in Europe because of local timbers, while their use in England was limited because of corrosion problems.

Many fastening systems were possible as the thin plate of the early steel tie made bolting an easy task. Unfortunately, some bolting systems became very complicated, particularly where different sizes of rail and change in gages was attempted. Loss and identification problems regarding the components of a bolted fastening system have resulted in unnecessary expense that has led to the lack of popularity in the steel cross tie.

Information relating to the performance of steel ties indicates several deficiences which must be corrected if a satisfactory tie is to be developed. Steel ties have a tendency to move in the ballast in the direction of train travel and become bunched even though properly spaced and ballasted originally. This occurs either because the retaining clips have inadequate holding power or because the ballast was not properly interlocking with the tie.

Based upon information obtained from both current and previous considerations, the following performance prerequisites must be considered if an acceptable steel tie is to be developed. First, the steel tie must resist bending moments (positive under the rails and negative at the center) in a manner similar to the present hardwood cross tie. Secondly, the steel cross tie must restrain track movements both in the lateral and longitudinal direction by interlocking with the ballast. Thirdly, the rails must be anchored securely to the cross tie (using rail anchors) to resist longitudinal movement. This is especially true for those situations in which welded rai is used. Fourth, unless the horizontal bearing surface of the tie is increased, present tie spacing on 24 inch centers for yard track and 22 inch centers for main line track must be maintained because the support of power of the present ballast and subgrade construction is at the allowable maximum for 100 ton cars.

One additional problem which must be solved relates to electrical insulation of the rail from the tie and other related equipment. Provision must be made for electrical insulation of the ties used in main line track from the rails so that existing traffic control and signaling systems can be used. In particular, switching and traffic control signals are currently sent through at least one of the rails on the track for controlling railroad traffic along the main line of a railway. With wood ties, this does not become a problem as the rail is automatically insulated from the tie by its inherent design. Insulation of the rails for track circuitry has been achieved by durable pads between the rail and the steel tie. Currently employed systems, however, do not fully insulate the rail from the other associated equipment or are not applicable to welded rail in which rail anchors must be used to prevent longitudinal movement of the rail. Moreover, any contemplated systems use a plethora of elements for achieving a singular insulative result and, as such, are cumbersome, expensive and easily lost.

SUMMARY OF THE INVENTION

The present invention is addressed to a unitary insulating element for a steel cross tie employed in supporting rails and conducting railroad trafficking signals therethrough. The insulative element, in its preferred embodiment, includes a base portion for insulating the rail to be placed thereon from the body of the steel tie, elements which insulate any rail retention elements associated with the steel tie and rail from the rail and additional elements which insulate the associated rail anchors used from the tie.

The unitary insulating element provides the advantage of ease of maintenance and manufacture in that all of the necessary rail insulative elements are integrally formed and cannot be lost or misplaced. Additionally, the rail anchor insulating elements are configured to accommodate a variety of rail anchor configurations without the necessity of changing insulators.

It is, therefore, a primary object and feature of the present invention to provide an integral insulating element for a steel cross tie for use in a railroad signal track conductance situation having means located thereon for both insulating the rail from the tie as well as for insulating the rail from the retention elements integrally formed in the tie.

It is a primary object and feature of the present invention to provide a unitary insulating member for a steel cross tie for placement thereon which requires no additional parts or elements for its correct and efficient insulating operation relative to the railroad rails, the rail retention elements or rail anchors.

It is a general object and feature of the present invention to provide a unitary insulating member for a steel cross tie having a plurality of both upwardly and downwardly depending insulating detents formed from the body of the member, the detents providing for insulation of the rail from the tie, the rail from rail anchors, and additionally, for insulating the rail from the rail retaining elements formed from the cross tie per se.

It is another object and feature of the present invention to provide an insulating element for a steel tie of minimal components to be employed within a railroad-signaling situation so as to minimize the time required for insertion and/or later maintenance.

Other objects and features of the invention will, in part, be obvious and will, in part, become apparent as the following description proceeds. The features of novelty which characterize the invention will be pointed out with particularity in the claims annexed to and forming part of the specification.

BRIEF DESCRIPTION OF THE DRAWINGS

The novel features that are considered characteristic of the invention are set forth with particularity in the annexed claims. The invention itself, however, both as to its structure and its operation together with the additional objects and advantages thereof will best be understood from the following description of the preferred embodiment of the invention when read in conjunction with the accompanying drawings wherein:

DETAILED DESCRIPTION OF THE INVENTION

Figure 1:
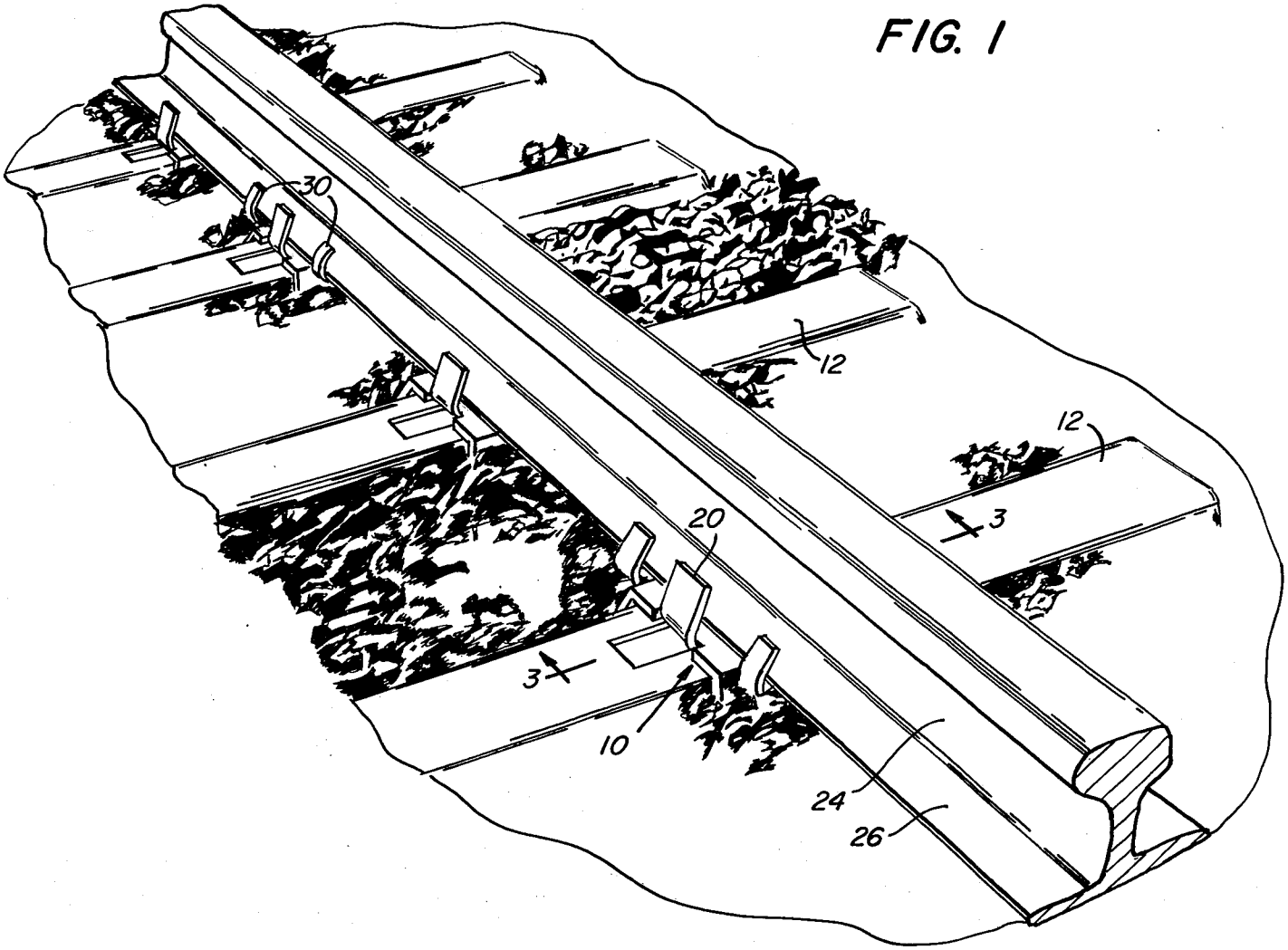
FIG. 1 is a perspective view of a plurality of steel cross ties in an operative associative position with respect to the insulative member according to the present invention.
Figure 3:
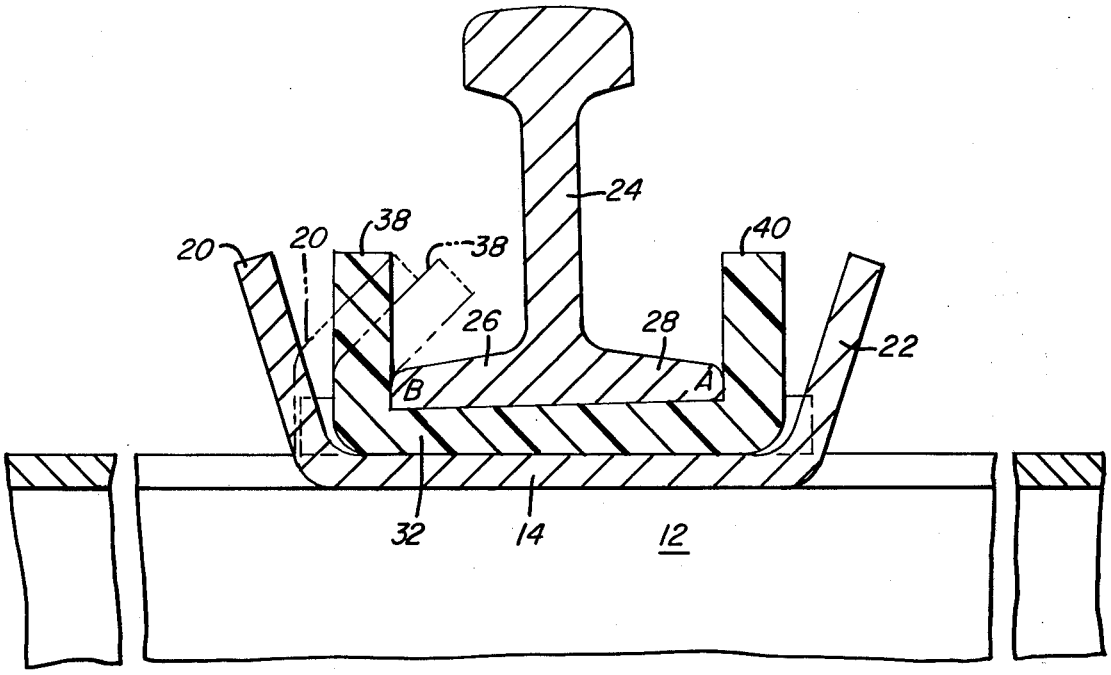
FIG. 3 is a cross-sectional view of the insulating member of FIG. 1 taken through the line 3—3.
Figure 4:
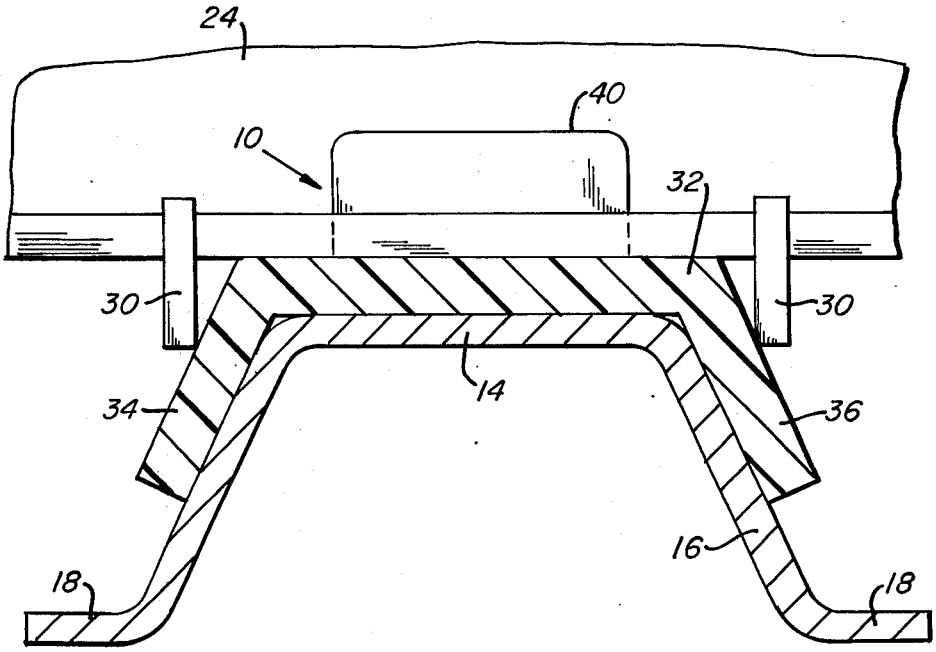
FIG. 4 is a cross-sectional view of the insulating member of FIG. 2 taken through the line 4—4 in association with a steel cross tie and rail shown in FIG. 1.

Referring to FIGS. 1, 3, and 4, there is shown a unitary insulative member 10 for use with a steel cross tie which is, in turn, associated with a supportive railroad ballast bed. The tie, indicated generally at 12, has a length (8'6") sufficient to accommodate standard track gage within the United States. The tie has a generally hat-shaped cross section (see FIG. 4) including a top planar support portion 14, angularly downwardly extending portions or legs 16 which are flared out horizontally to form a base support section 18 which provides support for both the tie and the rail to be placed transversely thereto. Hat-section or trough steel ties, as they are commonly referred to, have been employed within limited situations in the United States and the world for supporting railways for some time. It should be noted, however, that they have been subject to a variety of disadvantages. For instance, the amount of additional hardware necessary in order to retain the rail on the cross tie has been both expensive and cumbersome. The parts are generally lost or misplaced and require added expense in their manufacture and storage. Moreover, steel ties such as the trough variety have been susceptible in the past to a condition known as center binding. The problem of center binding, and specifically its solution relative to steel cross tie is described and claimed in a co-pending application for U.S. Patent entitled "Novel Steel Cross Tie Construction" by Joseph M. Wandrisco, Ser. No. 675,436, our Docket 1512, filed simultaneously herewith and assigned to the assignee of the present application.

Those associated with railroads in general, and apparatus for fastening rails to wooden, concrete, and steel ties in particular, indicate that the art is replete with a plethora of means and apparatus for securing the rail to the tie. The majority of these systems are susceptible of the criticism that they include too many parts for an efficient rail fastening system. In order to combat the variety of disadvantages appurtenant to such multi-elemented systems, a steel tie has been developed, which, in addition to increasing lateral stability of the track structure, also provides integral rail securing elements. Accordingly, the expense of manufacturing a variety of springs, clips, bolts and all the other necessary equipment is alleviated. The increased time and expense in maintaining such systems seems to be proportional to the number of individual parts associated therewith. Understandably, a majority of maintenance time is spent locating the individual parts necessary for repairs or alternatively, of finding that they are out of stock or misplaced.

The steel cross tie 12 according to the present invention incorporates two pairs of detents, one pair of which is shown at 20 and 22. The upwardly depending detents 20 and 22 are formed from the top planar support portion 14 and are canted upwardly during the manufacture of the tie. Not considering the problem of insulation, in order to secure a rail 24 to the top support portion 14 of the tie 12, the rail is first placed between two detents shown at 20 and 22. One of the two detents is forcefully bent into retaining association with one bottom flange 26 of the rail for securing the same in one lateral direction. The remaining detent is then forcefuly bent into engagement with the other side of the rail flange 28 for securing the rail against both possible lateral movements. The detents 20 and 22 are formed of ⅜ inch steel and have sufficient strength when bent, to retain the rail against lateral movement. The other side of the cross tie 10 is then provided with a rail in much the same manner as that priorly discussed. However, in order to provide for some degree of rail gage modification, the order of bending of the detents for the second rail becomes important. For instance, if a rail has priorly been inserted between the two detents 20 and 22 and they have been forcefully bent into engagement therewith, the remaining rail is placed between the other pair of detents (not shown) and the rail gage is measured. If the rail gage has been found to be somewhat too small, the inward detent of the second pair is first bent into engagement with the bottom flange of the second rail so as to force the same outwardly into engagement with the single non-bent detent. Subsequently, the remaining detent is moved into engagement with the rail in order to secure the same to the cross tie 10. Alternatively, if the gage is found to be too large then the outside detent is first bent into engagement with the rail and then the other detent is bent. In this manner, there is a slight modification effect to the gage of the rail merely by providing for an order of forcefully bending each of the detents into engagement with the bottom flange portion of the rail. A rail which has been secured to a plurality of cross ties is shown in FIG. 1.

The arrangement in FIG. 1, in addition to indicating the tie and rail retaining arrangement, shows the apparatus for preventing longitudinal movement of the rail 24 on the tie 12. Attached to the flange of the rail 24 (see FIGS. 1 and 4) are a plurality of rail anchors 30. Rail anchors, as is well known in the art, are clips or the like which are attached to the rail flange subsequent to rail placement on the tie. The rail anchors, irrespective of their specific configurement (and there are a variety of different shapes and sizes), are attached to the rail flange and usually extend below the rail and are clipped or attached to the other rail flange. The body of the rail anchor extends below the surface of the ballast and is designed to abut the side of the tie as shown in FIGS. 1 and 4. The engagement between the rail anchor (which is securely attached to the rail) and the tie prevents any substantial longitudinal movement of the rail relative to the tie. Inasmuch as many railways have single bi-directionally used track, rail anchors are located on both sides of the tie as indicated in FIGS. 1 and 4. If a track is used only unidirectionally, the rail anchor need only be placed on the opposite side of the tie from the direction of travel of the train. In any case, however, they are not usually placed on each and every rail/tie intersection.

The insulating element according to the present invention is employed to insulate the rail, which is carrying a signal voltage through it, from the rest of the equipment just discussed. These other elements include the tie per se, the rail retaining detents formed as a portion of the tie, and the rail anchors utilized to prevent longitudinal movement of the track by engaging both the rail itself as well as engaging the side of the tie. Any non-insulated contact between any of these elements and the rail will short out the rail and preclude its use as a convenient signal conveying means.

Figure 2:
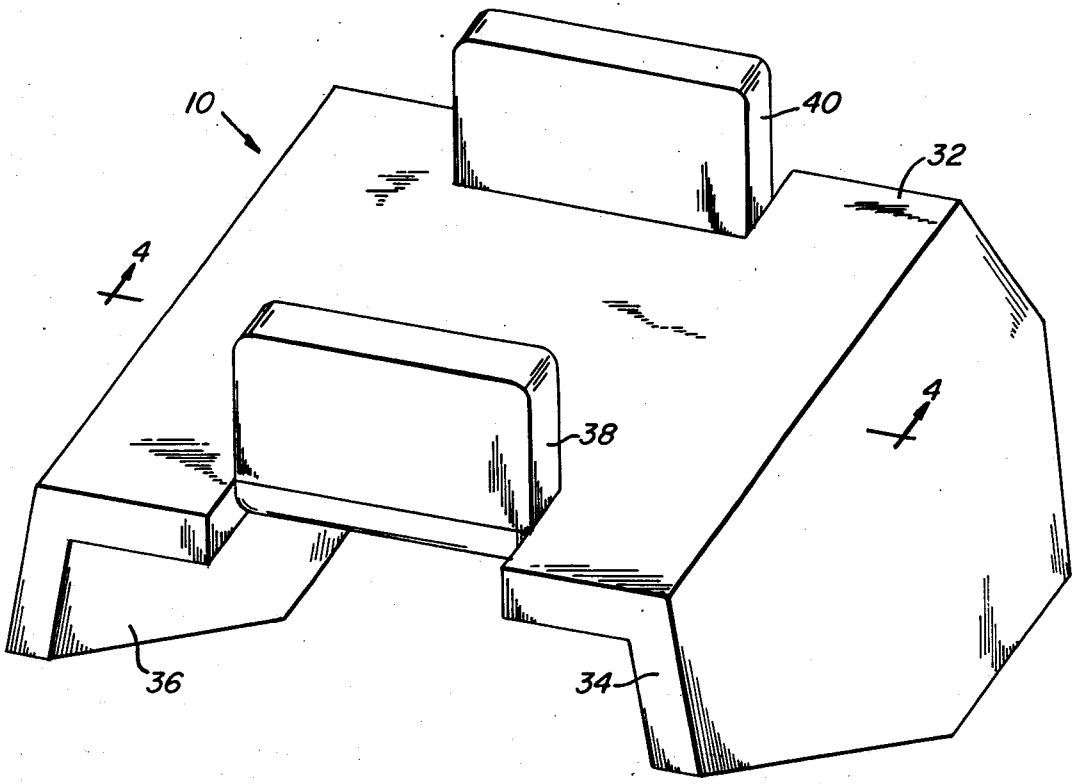
FIG. 2 is a perspective view of the insulating member according to the present invention.

The preferred embodiment of the unitized insulating member of the present invention may be best understood by referring to FIGS. 2, 3 and 4. As may be seen from FIG. 4, the unitized insulating member 10 has a generally saddle-shaped configuration. The member 10 includes a flat base 32 from which depend two planar legs 34 and 36 and two upwardly directed detents 38 and 40 which are oriented substantially normally to the plane of base 32 as well as to the planes of legs 34 and 36. The saddle 10 is formed from high density polyethylene and is of sufficient strength and rigidity to adequately support a rail thereupon. Moreover, the insulating member may additionally function as a tie plate to provide the usually accepted 1:40 inward cant to the rail or any other desired inward rail cant. The legs 34 and 36, as may be best seen by referring to FIG. 4, are angularly disposed with respect to base portion 32 in a similar manner to the angular disposition of the legs 16, of tie 12, with respect to the top planar support portion 14 thereof. Configured as such, the legs 34 and 36 and base 32 fit in a complimentary fashion over the portion 14 and legs 16 of the tie 12. The legs 34 and 36 are of sufficient width and length to insulatively accommodate substantially all of the various types of rail anchors, only one of which is shown at 30 in FIG. 4. However, there is functional similarity with respect to the variety of rail anchors commonly employed in the railroad business. Additionally, the legs 34 and 36 do not extend entirely down the full length of the tie legs 16 for permitting "ballast locking" of the tie within the surrounding ballast.

Extending upwardly from the sides of base 32, the detents 38 and 40 provide an insulative function for the area between the rail detents 20 and 22 and the rail 24 (see FIG. 3). When the tie detents 20 and 22 are forcefully moved into their rail retaining association with rail 24, the insulative detents 38 and 40 are moved along therewith and are located between the detents 20 and 22 and the rail 24 for insulating the latter from the detents and the tie from which they are formed. The high density polyethylene, from which the insulative member 10 and its detents 38 and 40 are formed, permits the flexible movement of the latter necessary for accommodating the movement of the tie detents from their initial positions to their rail retaining positions indicated in phantom in FIG. 3. Configured as such, the tie and insulating member detents 20 and 22 and 38 and 40, respectively, provide for the necessary lateral support for the rail 24, thereby preventing any substantial deleterious lateral movement of the rail relative to the tie. Additionally, the detents 38 and 40 also provide for the insulation of the rail necessary for railroad trafficking signals therethrough using a steel tie.

The insulating member 10 provides an additional feature necessary for proper rail positioning and orientation. Specifically, the base 32 of the member 10 has a generally wedge-shaped cross-section for providing an inward cant to the rail supported thereon. In essence, the base is formed having a slight 1:40 slope (or any other desired slope) between point A and point B (see FIG. 3) such that the base 32 is thicker at point A than it is at point B. This thickness differential, as is commonly employed in steel tie plates, cants the rail 24 inwardly the necessary 1.43° from the vertical (or any other inward cant) which has been found to provide for train stability and better riding quality.

It should be seen that the present rail retaining and insulating system provides for the insulative support of a signal carrying rail upon a steel cross tie. The system advantageously requires a minimum number of parts and pieces for effective retention of the rail upon the steel cross tie. As such, the possibility of loss or misplacement of pieces is drastically reduced as well as a conjunctive reduction in manufacturing and shipping costs. The insulative element of the present invention provides for all of the necessary insulative functions for a steel tie with a minimum of cost and pieces. In fact, the unitized character of the present insulating member provides, in conjunction with the above-noted rail retaining detents, for a two-element rail supporting and retaining system long needed in the heretofore multi-elemented and complicated rail supporting and retaining morass.

Accordingly, while certain changes may be made in the above-noted system and apparatus without departing from the scope of the invention herein involved, it is intended that all matter contained in the above description or shown in the accompanying drawings shall be interpreted as illustrative and not in a limiting sense.

I claim:

1. A unitized insulative element for use with a steel cross tie having associated rail retaining elements for preventing lateral movement of a rail on such steel tie and rail anchors for preventing longitudinal movement of such rail relative to such steel tie, said unitized insulative element comprising:

insulating base means adapted to be positioned between such rail and such steel tie for insulating the one from the other;

upwardly depending insulating detent means for insulating such rail retaining elements of such tie from such steel tie, said upwardly depending detent means being configured to provide means, relative to said base means and such associated rail retaining elements, for preventing movement of said unitized insulative element in a direction parallel to such railroad rail and in a direction normal thereto; and downwardly depending insulating means for insulating such steel tie from such rail anchors and additionally, for preventing movement of said unitized insulative element in a direction parallel to such railroad tie.

2. The unitized insulative element according to claim 1 in which said insulating base means is formed having a generally wedge shape for canting the rail to be supported thereon in a direction toward one of said upwardly depending detent means for providing a slight inward cant to the rail to be supported thereon.

3. The unitized insulative element according to claim 1 in which said unitized insulative element is formed from high density polyethylene.

4. The unitized insulative element according to claim 1 in which said upwardly depending insulating detent means are deformable along with such rail retaining elements of such steel tie for insulating such rail from such tie when such elements are placed in retaining engagement wih such rail.

5. The unitized insulative element according to claim 1 in which said upwardly depending detent means are oriented at right angles to said downwardly depending insulating means.

6. In combination, a steel tie, having integrally formed means for retaining a rail thereto and preventing movement of such rail relative to said tie, said rail being prevented from longitudinal movement relative to said tie by the use of rail anchors attached to such rail and which butt against a portion of said tie, and a unitized insulative member for electrically insulating the rail from said steel tie, said integrally formed retaining means and such rail anchors such that such rail may be employed for signal control purposes without being shorted out by said tie, said retaining means or such rail anchors, said unitized insulative member being configured having at least one means for preventing movement of said member relative to said steel tie in a direction parallel to the rail.

7. The unitized insulative element according to claim 6 in which said unitized insulative member is configured having means for providing a slight inward cant to such rail when such rail is supported by said insulative member on said tie.

8. The unitized insulative element according to claim 6 in which said unitized insulative member is formed from high density polyethylene.

9. The unitized insulative element according to claim 6 in which said unitized insulative member includes:

insulating base means, adapted to be positioned between such rail and said steel tie for electrically insulating one from the other;

upwardly depending insulating detent means for electrically insulating said integrally formed retaining means from said steel tie; and downwardly depending insulating means for electrically insulating said steel tie from such rail anchors.

10. The unitized insulative element according to claim 9 in which said upwardly depending insulation detent means are deformable for accommodating any movement of said integrally formed retaining means into retaining association with such rail.

* * * * *

UNITED STATES PATENT OFFICE

CERTIFICATE OF CORRECTION

Patent No. 4,061,270 Dated December 6, 1977

Inventor(s) Joseph M. Wandrisco

It is certified that error appears in the above-identified patent and that said Letters Patent are hereby corrected as shown below:

Column 2, line 11, change "rai" to -- rail --.

Column 2, line 60, after "as well as", insert -- means --.

Column 4, line 37, change "forcefuly" to -- forcefully --.

Signed and Sealed this

Eighteenth Day of April 1978

[SEAL]

*Attest:*

RUTH C. MASON
*Attesting Officer*

LUTRELLE F. PARKER
*Acting Commissioner of Patents and Trademarks*